US006041210A

United States Patent [19]

Chen et al.

[11] Patent Number: 6,041,210

[45] Date of Patent: Mar. 21, 2000

[54] ELECTROSTATIC CHARGE-SUPPRESSING FUSER ROLLER

[75] Inventors: Jiann H. Chen, Fairport; Robert A. Lancaster, Hilton, both of N.Y.; Andy H. Tsou, Houston, Tex.; Charles C. Anderson, Penfield, N.Y.

[73] Assignee: Eastman Kodak Company, Rochester, N.Y.

[21] Appl. No.: 09/335,371

[22] Filed: Jun. 17, 1999

Related U.S. Application Data

[63] Continuation-in-part of application No. 09/123,204, Jul. 27, 1998, abandoned.

[51] Int. Cl.[7] ..... G03G 15/20

[52] U.S. Cl. ..... 399/333; 399/324

[58] Field of Search ..... 399/324, 328, 399/333, 335

[56] References Cited

U.S. PATENT DOCUMENTS

| | | | |
|---|---|---|---|
| 3,810,776 | 5/1974 | Banks et al. | 427/194 |
| 4,029,827 | 6/1977 | Imperial et al. | 430/48 |
| 4,101,686 | 7/1978 | Strella et al. | 430/102 |
| 4,185,140 | 1/1980 | Strella et al. | 399/324 X |
| 4,257,699 | 3/1981 | Lentz | 399/333 X |
| 4,272,179 | 6/1981 | Seanor | 399/324 |
| 4,796,046 | 1/1989 | Suzuki et al. | 399/333 X |
| 4,845,369 | 7/1989 | Arkawa et al. | 250/484.4 |
| 4,970,559 | 11/1990 | Miyabayashi | 399/324 |
| 5,116,666 | 5/1992 | Konno | 428/220 |
| 5,331,385 | 7/1994 | Ohtsuka et al. | 399/333 X |
| 5,420,679 | 5/1995 | Goto et al. | 399/335 |
| 5,464,698 | 11/1995 | Chen et al. | 399/324 X |
| 5,512,409 | 4/1996 | Henry et al. | 430/124 |
| 5,516,361 | 5/1996 | Chow et al. | 106/2 |
| 5,735,945 | 4/1998 | Chen et al. | 106/287.14 |

*Primary Examiner*—Fred L. Braun
*Attorney, Agent, or Firm*—Raymond L. Owens

[57] ABSTRACT

A toner fuser roller with suppressed electrostatic charge build-up for fixing a toner image to a receiver includes a core; and an overcoat layer formed over the core and defining the surface that contacts the receiver, such overcoat layer including electrically conductive powders having a weight percentage between about 30 to 80 weight percent so as to make the overcoat layer electrically conductive and suppress electrostatic charge build-up and improve thermal conductivity.

11 Claims, 1 Drawing Sheet

ELECTROSTATIC CHARGE-SUPPRESSING FUSER ROLLER

CROSS REFERENCE TO RELATED APPLICATION

This application is a continuation-in-part of U.S. patent application Ser. No. 09/123,204, filed Jul. 27, 1998, now abandoned, the disclosure of which is incorporated herein.

FIELD OF THE INVENTION

This invention relates in general to electrostatographic imaging and in particular to the fusing of toner images. More specifically, this invention relates to fuser rollers having improved static charge suppression characteristics.

BACKGROUND OF THE INVENTION

In a typical electrostatographic reproducing apparatus, a light image of an original to be copied is recorded in the form of an electrostatic latent image upon a photosensitive member, and the latent image is subsequently rendered visible by the application of a thermoplastic resin toner powder. The visible toner image is initially in a loose powdered form that can be easily disturbed or destroyed but is usually fixed or fused on a receiver, which may be, for example, plain paper.

In order to fuse the toner particle image onto a receiver surface permanently by heat, it is necessary to elevate the temperature of the toner particles to a point at which they coalesce and become tacky. This heating causes the toner to flow to some extent into fibers or pores on the receiver surface. Thereafter, as the toner material cools, its solidification causes it to be firmly bonded to the receiver surface.

Typically, thermoplastic resin particles are fused to the substrate by heating, generally to a temperature of about 90° C. to 160° C., but sometimes higher, depending on the softening range of the particular resin used in the toner. It is not desirable, however, to exceed a temperature of about 200° C. because of the tendency of the receiver to discolor at such elevated temperatures, particularly if it includes a paper substrate.

Several approaches to thermal fusing of toner images have been described in the prior art, including the substantially concurrent application of heat and pressure. This may be achieved by, for example, a pair of rollers, a fuser roller and a pressure roller that are maintained in pressure contact, a fuser plate or belt member in pressure contact with a pressure roller, and the like. Heat may be applied to one or both of the rolls, plates, or belts. The fusing of the toner particles takes place when the proper combination of heat, pressure and contact time are provided. The balancing of these parameters to bring about the fusing of the toner particles is well known in the art and can be adjusted to suit particular machines or process conditions.

During operation of a fusing system in which heat is applied to cause thermal fusing of the toner particles onto a support, both the toner image and the receiver are passed through a nip formed between the roller pair, or between the pressure roller and fuser plate or belt member. The concurrent transfer of heat and the application of pressure in the nip effects the fusing of the toner image onto the receiver. It is important in the fusing process that no offset of the toner particles from the support to the fuser member take place during normal operations. Toner particles offset onto the fuser member may subsequently transfer to other parts of the machine or onto the receiver in subsequent copying cycles, thereby increasing the background or interfering with the material being copied there. "Hot offset" occurs when the temperature of the toner is raised to a point where the toner particles liquefy during the fusing operation, and a portion of the molten toner remains on the fuser member. The extent of hot offset is a measure of the release property of the fuser roll; accordingly, it is desirable to provide a fusing surface having a low surface energy to enable the necessary release.

For further improvement in the release properties of the fuser member, it is customary to apply release agents to the fuser member surface to ensure that the toner is completely released from the surface during the fusing operation. Typically, release agents for preventing toner offset are applied as thin films of, for example, silicone oils. U.S. Pat. No. 3,810,776 describes a release agent of a low viscosity silicone oil in which is dispersed a high viscosity component such as zinc or aluminum stearate or behenate. Polyorganosiloxanes containing various functional groups that interact with a fuser member surface are well known in the art. For example, mercapto-functionalized polyorganosiloxanes are disclosed in U.S. Pat. No. 4,029,827, and analogous amino-functionalized materials are described in U.S. Pat. Nos. 5,512,409 and 5,516,361. Silicone release oils containing other functional groups such as carboxy, hydroxy, epoxy, and isocyanate are described in U.S. Pat. Nos. 4,101,686 and 4,185,140.

In a fusing system including a nip formed by a pair of rollers, the pressure roller is commonly provided with a surface layer, or sleeve, of a fluorocarbon plastic such as, for example, a perfluoroalkoxy (PFA) polymer, a fluoroethylenepropylene (FEP) polymer, or a tetrafluoroethylene (TFE) polymer over a more resilient blanket layer such as, for example, a silicone rubber. The surface of the fuser roller, which is often but not necessarily more resilient than the pressure roller surface, may comprise, for example, a silicone rubber or a fluoroelastomer.

Regardless of the materials employed, contact between the roller surfaces during passage of a toner image receiver, usually paper, through the nip causes an electrostatic charge to build up on the fuser roller surface. The magnitude and polarity of the electrostatic charge depends at least in part on the relative position of the pressure and fuser roller surface materials in the triboelectric series. In L. B. Schein, *Electrophotography and Development Physics*, 2nd edition, Springer-Verlag, New York, 1992, page 78, is presented a triboelectric series table showing a silicone elastomer with silica filler at the extreme positive end of the series and polytetrafluoroethylene at the extreme negative end.

Generation of an electrostatic charge at the roller nip may, depending on the magnitude and polarity of the charge on the fuser roller surface and the surface charge properties of the toner composition particles employed, result in serious problems of toner offset or paper jamming, or both. It is therefore desirable to prevent or suppress the buildup of static charge at the nip to keep it at a very low level, ideally zero.

U.S. Pat. No. 4,970,559 describes a mixture for forming a roller layer that comprises an organic polymer and an inorganic fine powder carrying an absorbed liquid antistatic agent. In commonly assigned U.S. Pat. No. 5,735,945, a static charge-suppressing release agent for pressure and fuser rollers is described. A problem with using static-charge suppressing release agents is that they have to be continuously applied in the correct amounts. If an incorrect amount of release agent is applied image artifacts can result.

SUMMARY OF THE INVENTION

It is an object of the present invention to provide fuser rollers which effectively minimize electrostatic charge.

This object is achieved in a toner fuser roller with suppressed electrostatic charge build-up for fixing a toner image to a receiver comprising:

(a) a core; and (b) an overcoat layer formed over the core and defining the surface that contacts the receiver, such overcoat layer including electrically conductive fine powder having a weight percentage between about 30 to 80 weight percent so as to make the overcoat layer electrically conductive and suppress electrostatic charge build-up and improve thermal conductivity.

In accordance with the invention, a fuser roller for electrostatography that is effective to prevent or substantially suppress electrostatic charging of toner fuser roller during fusion of thermoplastic toner on a receiver comprises an elastomer and an inorganic fine powder that is electrically conductive. The fuser roller preferably comprises about 30 to 80 weight percent of electrically conductive fine powder, more preferably about 50 to 80 weight percent.

By selecting the weight percentage of the electrically conductive fine powder to be between 30 and 80 weight percent, the fuser roller prevents and substantially suppresses electrostatic charging of a fuser roller surface, the present invention provides improved copier machine performance and copy quality.

DETAILED DESCRIPTION OF THE PREFERRED EMBODIMENT

Figure 1:
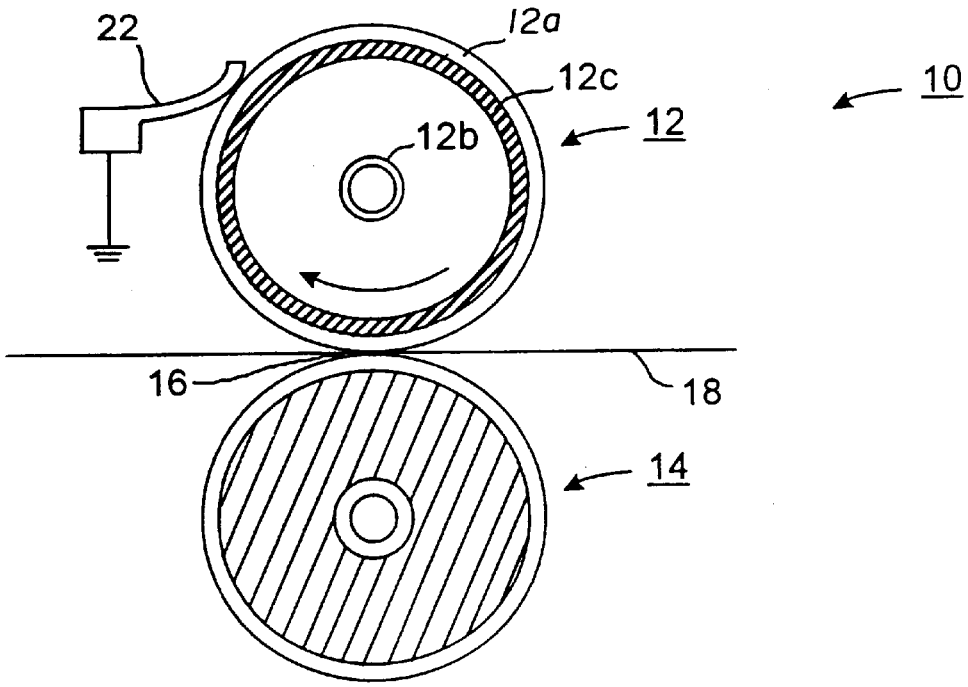
FIG. 1 is a cross-sectional view of a fusing system having a fuser roller and a pressure roller which forms a nip wherein a toner image is fixed to a receiver and showing a first way of grounding the fuser roller.

Turning now to FIG. 1, where a simplified fusing system 10 in accordance with the present invention is shown. The fusing system 10 includes a toner fuser roller 12, and a pressure roller 14 which form a nip 16. At the nip 16 a toner image on a receiver 18 is fixed by pressure to the receiver 18. Heat can also be applied at the nip 16 to aid in this fixing process. As thus far described the fusing system 10 is conventional. However, the toner fuser roller 12 has an improved overcoat layer 12*a* with conductive particles in an amount selected to make the overcoat layer electrically conductive and suppress electrostatic charge build-up and improves thermal conductivity. The toner fuser roller 12 also has a conductive core 12*b* that can be made of metal. Although it is not necessary, a base cushion 12*c* often provides advantages in the fixing process and is formed directly on the core 12*b*. In any event the toner fuser roller 12 has an outer overcoat layer 12*a* which contains electrically conductive fine powders. In order to ground the toner fuser roller 12, a conductive flat spring 22 typically made of metal physically contacts the top surface of the overcoat layer 12*a*. The conductive flat spring 22 is connected to machine ground.

Figure 2:
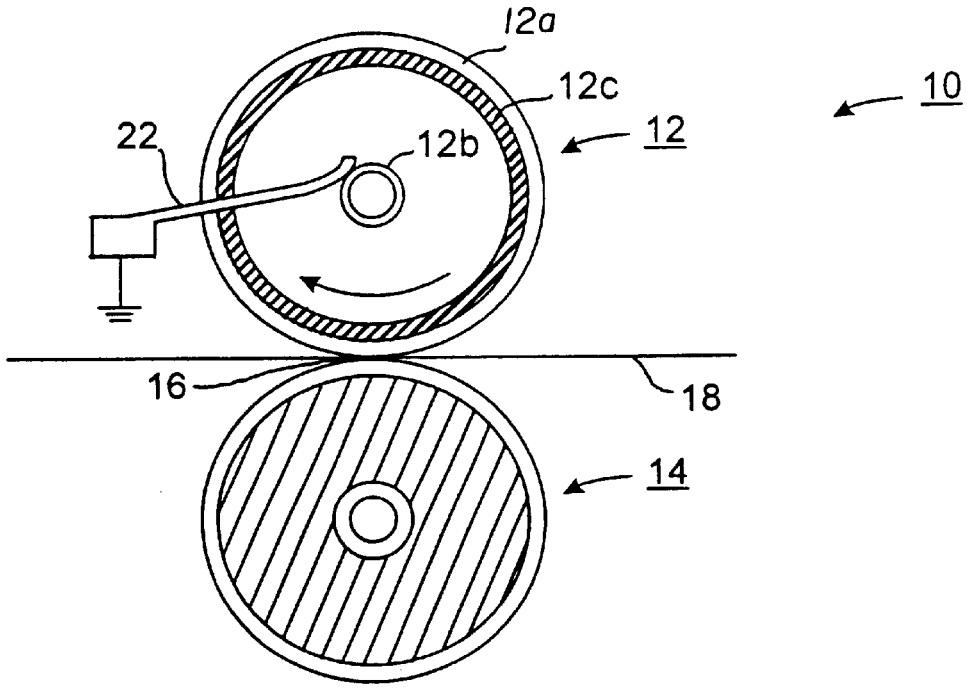
FIG. 2 is a cross-sectional view of a fusing system having a fuser roller and a pressure roller which forms a nip wherein a toner image is fixed to a receiver and showing a second way of grounding the fuser roller.

FIG. 2 is similar to FIG. 1 and where parts correspond they carry the same numbers. In this embodiment, grounding is achieved in a second way by having the flat conductive spring 22 contact the core 12*b*. Also, in order to complete an electrical connection the base cushion 12*c* has to be conductive. Conductive particles can also be formed in the base cushion 12*c* in an amount sufficient to make it electrically conductive so that charge can be directly coupled from the surface of the toner fuser roller 12 through the overcoat layer 12*a* and the base cushion 12*c* and out to ground by way of the core 12*b*. The electrically conductive fine powders of the present invention include doped-metal oxides, metal oxides containing oxygen deficiencies, metal antimonates, conductive nitrides, carbides, or borides. These conductive fine powders exhibit electronic conductivity which depends primarily on electronic mobilities rather than ionic mobilities, and therefore, the observed conductivity is independent of relative humidity and only slightly influenced by ambient temperature. The toner fuser roller 12 of the present invention has superior antistatic properties compared with the roller layer compositions described in the aforementioned '559 patent which contain an inorganic fine powder carrying an absorbed liquid antistatic agent that exhibits humidity dependent, ionic conductivity. Representative examples of electrically conductive fine powders suitable for use in the present invention include electronically conductive $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. Suitable, commercially available conductive fine powders include antimony-doped tin oxide such as STANOSTAT powders from Keeling & Walker, Ltd., T1 from Mitsubishi Metals Corp., and FS-10P from Ishihara Sangyo Kaisha Ltd., and zinc antimonate such as Celnax CX-Z from Nissan Chemical Co., and others.

Also included are powders having an electrically conductive metal oxide shell such as antimony-doped tin oxide coated onto a non-electrically conductive metal oxide particle core such as potassium titanate or titanium dioxide. Such core-shell particles are described in U.S. Pat. Nos. 4,845,369 and 5,116,666, and are available commercially, for example, as Dentall WK200 from Otsuka Chemical, W1 from Mitsubishi Metals Corp., and Zelec® ECP-T-MZ from DuPont.

The electrically conductive fine powders of the invention may comprise particles that are substantially spherical in shape, or they may be whiskers, fibers, or other geometries. The electrically conductive fine powder has an average particle size less than about 20 $\mu$m, more preferably less than about 5 $\mu$m. The electrically conductive fine powder is selected to have a powder resistivity of about $10^2$ $\Omega$ or less. The weight percentage of the electrically conductive fine powder is selected to be between about 30 to 80 weight percent so as to make the overcoat layer 12*a* electrically conductive and suppress electrostatic charge build-up and improve thermal conductivity. More preferably, the weight percentage of electrically conductive fine powders is about 50 to 80 weight percent.

The overcoat layer 12*a* and the base cushion 12*c* can be formed of an elastomer such as a silicone rubber or a fluoroelastomer. Suitable silicone rubbers include, for example, EC-4952 from Emerson Cuming and Silastic™ E from Dow Corning. Suitable fluoroelastomers include, for example, Fluorel™ elastomers from 3M, Viton™ fluoropolymers from DuPont, and Supra™ blend of PTFE and PFA fluoropolymers from DuPont.

In order to make the overcoat layer 12*a* in FIG. 1 conductive and the overcoat layer 12*a* and base cushion 12*c* in FIG. 2 conductive, a sufficient amount of conductive particles have to be added to these materials. This can be determined empirically by adding particles and the conductivity of the layer or cushion can be measured and there is a region where it rapidly changes from non-conductive to conductive. This is often referred to in the art as "the percolation threshold." The overcoat layer 12*a* of FIG. 1 and both the overcoat layer 12*a* and base cushion 12*c* of FIG. 2 both comprises about 30 to 80 weight percent, more preferably about 50 to 80 weight percent of the electrically conductive fine powder. With these amounts both of these elements become highly conductive and are capable of charge suppression.

The overcoat layer 12*a* can for example include a cured fluorocarbon random copolymer having subunits with the following general structures:

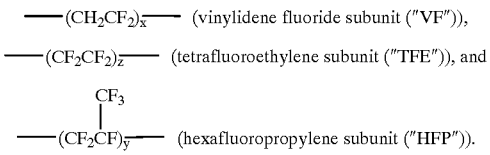

In these formulas, x, y, and z are mole percentages of the individual subunits relative to a total of the three subunits (x+y+z), referred to herein as "subunit mole percentages". (The curing agent can be considered to provide an additional "cure-site subunit", however, the contribution of these cure-site subunits is not considered in subunit mole percentages.) In the fluorocarbon copolymer, x has a subunit mole percentage of from 30 to 90 mole percent, y has a subunit mole percentage of from 10 to 70 mole percent, and z has a subunit mole percentage of from 0 to 34 mole percent. In a currently preferred embodiment of the invention, subunit mole percentages are: x is from 40 to 80, y is from 10 to 60, and z is from 0 to 34; or more preferably x is from 42 to 75, y is from 14 to 58, and z is 0. In the currently preferred embodiments of the invention, x, y, and z are selected such that fluorine atoms represent at least 70 percent of the total formula weight of the VF, HFP, and TFE subunits. The conductive particles are blended into the elastomers as they are being formed. Typically the elastomers are milled and during this milling process it is convenient to add the conductive particles.

In curing an overcoat polymer of the overcoat layer 12*a* alkali metal oxides, alkali metal hydroxides, and combinations of alkali metal oxides and hydroxides are used and can be found in the overcoat polymer. An examples of alkali metal oxide is a mixture of magnesium oxide and calcium hydroxide.

To form the overcoat layer 12*a*, the electrically conductive fine powders are mixed with uncured overcoat polymer, crosslinking agent, and any other additives, such as an accelerator; shaped over the base cushion, and cured. When the overcoat polymer is a fluorocarbon, it is cured by crosslinking with basic nucleophile. Basic nucleophilic cure systems are well known and are discussed, for example, in U.S. Pat. No. 4,272,179. One example of such a cure system combines a bisphenol as the crosslinking agent and an organophosphonium salt, as an accelerator. An example bisphenol is:

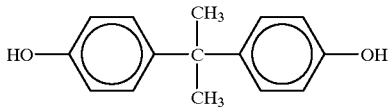

An example organophosphonium salt is:

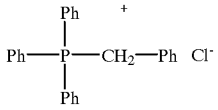

The crosslinker is incorporated into the uncured overcoat polymer as a cure-site subunit, for example, bisphenolic residues. Other examples of nucleophilic addition cure systems are sold commercially as DIAK No. 1 (hexamethylenediamine carbamate) and DIAK No. 3 (N,N'-dicinnamylidene-1,6-hexanediamine) by E.I. duPont de Nemours & Co.

Suitable uncured overcoat polymers are available commercially. In a particular embodiment of the invention, a vinylidene fluoride-co-hexafluoropropylene was used which can be represented as—$(VF)_{75}$—$(HFP)_{25}$—.

This material is marketed by E.I. duPont de Nemours and Company under the designation "Viton A" and is referred to herein as "Viton A". In another embodiment of the invention, a vinylidene fluoride-co-hexafluoropropylene was used which can be represented as—$(VF)_{42}$—$(HFP)_{58}$—. This material is marketed by Minnesota Mining and Manufacturing, St. Paul, Minn., under the designation "Fluorel FX-2530" and is referred to herein as "FX-2530". Other suitable uncured vinylidene fluoride-co-hexafluoropropylenes and vinylidene fluoride-co-tetrafluoroethylene-co-hexafluoropropylenes are available, for example, Fluorel "FX-9038".

The molecular weight of the uncured overcoat polymer is largely a matter of convenience, however, an excessively large or excessively small molecular weight would create problems, the nature of which are well known to those skilled in the art. In a preferred embodiment of the invention the uncured overcoat polymer has a number average molecular weight in the range of about 100,000 to 200,000.

The toner fuser roller 12 is mainly described herein in terms of embodiments in which the toner fuser roller 12 has a conductive core, a base cushion layer overlying the core, and an outer layer superimposed on the base cushion. The toner fuser roller 12 of the invention can have a variety of other configurations and layer arrangements known to those skilled in the art. For example, the base cushion could be eliminated.

The invention is further illustrated by the following Example.

EXAMPLE

Measurement of electrostatic charge generation in toner fuser roller materials.

The electrostatic charging characteristics of the material of several overcoats were measured by the following procedure:

A molded slab having a thickness of about 75 mils (1900 pl) was prepared from each material and cut into samples approximately 2 inches (5 cm) square. The samples were cleaned with alcohol and placed in an ionizing air blower (No. 4003367 from Simco Inc.) for 1 minute prior to testing. Each sample was rubbed by an operator wearing vinyl gloves back and forth 20 times against a test pressure roller of 33 cm length and 5 cm outside diameter and comprising a silicone rubber blanket and a perfluoroalkoxy (PFA) polymeric sleeve. The electrostatic charge generated on the sample surface was then measured using a Model 230 nanocoulombmeter and a Model 231 Faraday cup, manufactured by Electro-tech Systems, Inc.

The following overcoat materials were included in the test (all parts are by weight):

(Comparative Sample A): 100 parts Viton™ F 605C fluoropolymer (duPont) and 20 parts copper(II) oxide.

(Comparative Sample B): 100 parts Viton™ F 605C fluoropolymer (duPont) and 35 parts copper(II) oxide.

(Comparative Sample C): 100 parts Viton™ F 605C fluoropolymer (duPont) and 59 parts copper(II) oxide.

(Comparative Sample D): 100 parts Fluorel™ FE 5840Q fluoroelastomer (3M) and 138 parts of non-electrically conductive tin oxide (G2 available from Magnesium Elektron Ing., Flemington, N.J.)).

(Comparative Sample E): 100 parts Fluorel™ FE 5840Q fluoroelastomer (3M) and 138 parts of non-electrically conductive tin oxide (CS3 available from Magnesium Elektron Ing., Flemington, N.J.) ).

(Comparative Sample F): silicone rubber EC-4592 from Emerson Cuming, without fillers.

(Comparative Sample G): Fluorel™ FX 2530 fluoroelastomer (3M) without fillers.

(Example): 100 parts Fluorel™ FE 5840Q fluoroelastomer (3M) and 138 parts CPM375, an electrically conductive, antimony-doped tin oxide (Keeling & Walker, Ltd.) having an average particle size of approximately 0.4 $\mu$m and a powder resistivity of 2 Ω.cm.

In TABLE 1 below are listed the measured electrostatic charge values in nanocoulombs for the above samples, obtained by rubbing each sample against the toner fuser roller. The tabulated values are the average of 8 separate measurements.

TABLE 1

| Sample | Electrostatic charge (nanocoulombs) |
|---|---|
| Comparative Sample A | +5.3 |
| Comparative Sample B | +6.7 |
| Comparative Sample C | +5.0 |
| Comparative Sample D | +1.2 |
| Comparative Sample E | +1.8 |
| Comparative Sample F | +20.0 |
| Comparative Sample G | −16.0 |
| Example | −0.01 |

As shown by the data in TABLE 1, a toner fuser roller material of the invention containing an electrically conductive fine powder had essentially no measurable static charge buildup compared with the comparative compositions that did not contain any filler (+20.0 nanocoulombs for Sample F and −16.0 nanocoulombs for Sample G) and the comparative compositions that contained electrically conductive fine powders not of the invention (within the range +1.2 to +6.7 nanocoulombs for Samples A through E).

The invention has been described in detail with particular reference to preferred embodiments thereof, but it will be understood that variations and modifications can be effected within the spirit and scope of the invention.

PARTS LIST

10 fusing system
12 fuser roller
12*a* overcoat layer
12*b* conductive core
12*c* base cushion
14 pressure roller
16 nip
18 receiver
22 spring

What is claimed is:

1. A toner fuser roller with suppressed electrostatic charge build-up for fixing a toner image to a receiver comprising:

(a) a core; and (b) an overcoat layer formed over the core and defining the surface that contacts the receiver, such overcoat layer including electrically conductive fine powder having a weight percentage between about 30 to 80 weight percent so as to make the overcoat layer electrically conductive and suppress electrostatic charge build-up and improve thermal conductivity.

2. The toner fuser roller according to claim 1 wherein the electrically conductive fine powders are selected from the group consisting of $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC.

3. The toner fuser roller of claim 1 wherein the weight percent of electrically conductive fine powder is between about 50 to 80 weight percent.

4. A toner fuser roller with suppressed electrostatic charge build-up for fixing a toner image to a receiver comprising:

(a) a core, (b) an overcoat layer formed over the core having a cured fluorocarbon random copolymer having the following subunits:

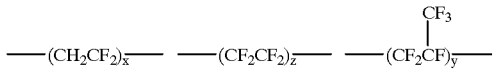

wherein:

x, y, and z are mole percentages and electrically conductive fine powders having a weight percentage between about 30 to 80 weight percent so as to make the overcoat layer electrically conductive and suppress electrostatic charge build-up and improve thermal conductivity.

5. The toner fuser roller according to claim 4 wherein the electrically conductive fine powders are selected from the group consisting of $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC.

6. A toner fuser roller with suppressed electrostatic charge build-up for fixing a toner image to a receiver comprising:

(a) a core, (b) a base cushion disposed over the core;

(c) an overcoat layer formed over the base cushion having a cured fluorocarbon random copolymer having the following subunits:

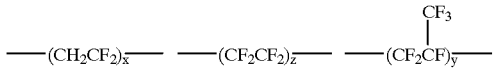

wherein:

x, y, and z are mole percentages and electrically conductive fine powders having a weight percentage between about 30 to 80 weight percent so as to make the overcoat layer electrically conductive and suppress electrostatic charge build-up and improve thermal conductivity.

7. The toner fuser roller according to claim 6 wherein the electrically conductive fine powders are selected from the group consisting of $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC.

8. A toner fuser roller with suppressed electrostatic charge build-up for fixing a toner image to a receiver comprising:

(a) a core;

(b) an overcoat layer formed over the core and defining the surface that contacts the receiver, such overcoat layer including electrically conductive fine powder having a weight percentage between about 30 to 80 weight percent so as to make the overcoat layer electrically conductive and suppress electrostatic charge build-up and improve thermal conductivity; and (c) means for grounding the overcoat layer.

9. The toner fuser roller of claim 8 wherein the grounding means includes a grounded conductive flat spring in contact with the surface of the overcoat layer.

10. The toner fuser roller of claim 8 further including a base cushion formed over the core and the overcoat layer provided on the base cushion.

11. The toner ftiser roller of claim 8 wherein the grounding means includes a conductive flat spring in contact with the core and the base cushion includes electrically conductive fine powders.

* * * * *